US009321554B2

(12) United States Patent
Tabor

(10) Patent No.: US 9,321,554 B2
(45) Date of Patent: Apr. 26, 2016

(54) SHIPPING CONTAINER WITH SHELVES

(71) Applicant: Keith S. Tabor, Ferndale, MI (US)

(72) Inventor: Keith S. Tabor, Ferndale, MI (US)

(73) Assignee: Packaging Specialties, Inc., Warren, MI (US)

( * ) Notice: Subject to any disclaimer, the term of this patent is extended or adjusted under 35 U.S.C. 154(b) by 0 days.

(21) Appl. No.: 14/464,373

(22) Filed: Aug. 20, 2014

(65) Prior Publication Data

US 2014/0354128 A1 Dec. 4, 2014

Related U.S. Application Data

(63) Continuation-in-part of application No. 11/818,077, filed on Jun. 12, 2007, now abandoned.

(51) Int. Cl.
*B65D 19/44* (2006.01)

(52) U.S. Cl.
CPC ..... *B65D 19/44* (2013.01); *B65D 2519/00019* (2013.01); *B65D 2519/00054* (2013.01); *B65D 2519/00064* (2013.01); *B65D 2519/0082* (2013.01); *B65D 2519/00159* (2013.01); *B65D 2519/00194* (2013.01); *B65D 2519/00288* (2013.01); *B65D 2519/00452* (2013.01); *B65D 2519/00497* (2013.01); *B65D 2519/00502* (2013.01); *B65D 2519/00562* (2013.01); *B65D 2519/00572* (2013.01); *B65D 2519/00621* (2013.01); *B65D 2519/00666* (2013.01); *B65D 2519/00711* (2013.01)

(58) Field of Classification Search
CPC ..... B65D 19/44; B65D 2519/00452; B65D 2519/0082; B65D 2519/00502; A45F 5/11; A45F 5/112; A45F 5/116; A47B 43/02; A47B 47/06
USPC ..... 211/73, 72, 153, 40
See application file for complete search history.

(56) References Cited

U.S. PATENT DOCUMENTS

| | | | | |
|---|---|---|---|---|
| 4,008,936 | A | 2/1977 | Meller et al. | 312/352 |
| 4,502,597 | A | 3/1985 | Cantey | 206/392 |
| 5,324,105 | A | 6/1994 | Christensen | 312/319.4 |
| 5,473,995 | A | 12/1995 | Gottlieb | 108/513 |
| 5,642,923 | A | 7/1997 | Meacham et al. | 312/258 |
| 5,667,090 | A | 9/1997 | Langham, Jr. et al. | 220/6 |
| 5,794,542 | A | 8/1998 | Besaw | 108/513 |
| 6,041,718 | A | 3/2000 | Brandes et al. | 108/513 |
| 6,296,133 | B1 | 10/2001 | Cobane | 220/6 |
| 6,405,880 | B1 | 6/2002 | Webb | 211/59.2 |
| 6,581,769 | B2 | 6/2003 | Nist | 206/386 |
| 6,607,083 | B1 | 8/2003 | Webb | 211/59.02 |
| 6,783,012 | B2 | 8/2004 | Webb | 211/59.02 |
| 6,832,562 | B2 | 12/2004 | Tabor et al. | 108/55.1 |
| 2003/0042297 | A1 * | 3/2003 | Remaks et al. | 229/109 |

* cited by examiner

*Primary Examiner* — Stephen Castellano
(74) *Attorney, Agent, or Firm* — L.C. Begin & Associates, PLLC.

(57) ABSTRACT

A shipping container includes a first wall assembly and a first shelf support member secured to the first wall assembly. The first shelf support member includes a first shelf bearing portion. A second shelf support member is secured to the first wall assembly, and is separate from and spaced apart from the first shelf support member. The second shelf support member includes a second shelf bearing portion. A first slot is defined adjacent to the first shelf bearing portion on the first shelf support. A second slot is defined adjacent to the second shelf bearing portion on the second shelf support. A shelf member includes a first tab and a second tab, the first tab being fixed within the first slot, and the second tab being fixed within the second slot. A portion of the shelf member spans a distance between the first and second shelf support members.

11 Claims, 8 Drawing Sheets

SHIPPING CONTAINER WITH SHELVES

CROSS-REFERENCE TO RELATED APPLICATIONS

This application is a continuation-in-part of, and claims the benefit of U.S. application Ser. No. 11/818,077, filed on Jun. 12, 2007, now abandoned, which claims the benefit of U.S. Provisional Patent Application Ser. No. 60/812,906 having a filing date of Jun. 12, 2006, the disclosures of which are hereby incorporated by reference.

TECHNICAL FIELD

The present invention relates generally to shipping and storage containers, and more particularly to a novel shelf assembly within such a container.

BACKGROUND OF THE INVENTION

Many different shipping container designs have been developed over the years, some having relatively elaborate interior shelf and article-positioning systems. One such example is found in U.S. Pat. No. 5,667,090 to Langham et al., which discloses an octagonal shipping container for shipping stackable manufactured articles. The Langham container includes a plurality of attached slotted wall panels defining an interior storage cavity. Langham further discloses a plurality of shelf arms which project through the slots to engage goods positioned in the storage cavity. Langham represents one method of storing and shipping stackable manufactured articles, in particular steering wheels. However, there is always room for improvement. For instance, the Langham container must be laid on its side upon a support fixture for loading, necessarily increasing the time and effort required to place articles into, or remove them from, the container. Further, Langham requires a separable fastener to secure the sides of the container.

Co-owned U.S. Pat. No. 6,832,562, herein incorporated by reference in its entirety, describes a shipping container for stackable articles. The container includes a base assembly, a plurality of side assemblies, to top assembly, and a plurality of shelf assemblies. The base assembly, side assemblies, and top assembly are preferably constructed of a multiple layer, corrugated laminate, and are attachable to one another, defining an interior storage space. Each shelf assembly includes a plurality of shelf support blocks with a plurality of face sections distributed along a length, and a shelf flap. The shelf assemblies are secured to the sidewall assemblies, and positioned in the storage space to engage manufactured articles, for example sunroofs, positioned therein. The design of this container provided certain advantages including the elimination of wood augmentation in the container, thereby meeting customer requirements that mandated the elimination of wood due to infestation concerns. Furthermore, the likelihood of damage to articles shipped within this container was substantially reduced due to the enhanced strength of the shelf assemblies. The load time of sunroofs, for example, was also substantially reduced given the prefabricated shelf assemblies within this container. Nevertheless, continued goals include providing even stronger shelf assemblies, and reducing the manufacturing complexity associated with shipping containers.

It is thus desirable to construct a container for stackable goods that can be easily assembled and loaded, yet is strong and durable. The present invention addresses one or more of the limitations or problems associated with the related art.

SUMMARY OF THE INVENTION

In one aspect of the embodiments described herein, a container for shipping and storing manufactured articles is provided. The container includes a base and a container body portion secured to the base. The container body portion defines an interior of the container. A first wall assembly is secured to the container body, the first wall assembly including a first shelf assembly protruding into the interior. The first shelf assembly includes a first shelf support member and a second shelf support member spaced apart from the first shelf support member, for supporting at least one shelf member. A first shelf member includes a first end and a second end, a first tab at the first end, a second tab at the second end, a first flap, and a first aperture. First and second bearing portions for supporting the first shelf member are also provided. The second bearing portion is positioned adjacent the first bearing portion. The first and second bearing portions are formed integral to the first shelf support member. The first and second bearing portions define a first slot therebetween. The first tab is fixed within the first slot. Third and fourth bearing portions are also provided for supporting the first shelf member. The fourth bearing portion is positioned adjacent the third bearing portion. The third and fourth bearing portions are formed integral to the second shelf support member. The third and fourth bearing portions define a second slot therebetween. The second tab is fixed within the second slot.

In another aspect of the embodiments described herein, a shipping container is provided. The container includes a first wall having a first shelf support member, the first shelf support member including a first plurality of adjacent and integral shelf bearing portions. The first wall also includes a second shelf support member, the second shelf support member being separate from and spaced apart from the first shelf support member. The second shelf support member includes a second plurality of adjacent and integral shelf bearing portions, each one of the second plurality of shelf bearing portions corresponding to one of the first plurality of shelf bearing portions. A first plurality of slots is provided, each slot of the first plurality of slots being defined between two adjacent shelf bearing portions of the first plurality of shelf bearing portions. A second plurality of slot is also provided, each Slot of the second plurality of slots defined between two adjacent shelf bearing portions of the second plurality or shelf bearing portions. A first plurality of shelf members extends between the first and second shelf support members, each shelf member comprising a first tab, a second tab, a third tab, and an aperture. Each first tab is fixed within one slot of the first plurality of slots. Each second tab is fixed within one slot of the second plurality of slots. Each third tab mates with an aperture of an adjacent shelf member.

In another aspect of the embodiments described herein, a wall assembly for a shipping container is provided. The wall assembly includes at least one wall portion and a first shelf support member secured to the at least one will portion. The first shelf support member includes a first shelf bearing portion. A second shelf support member is also secured to the at least one wall portion. The second shelf support member is separate from and spaced apart from the first shelf support member. The second shelf support member includes a second shelf bearing portion. A first slot is defined adjacent to the first shelf bearing portion on the first shelf support. A second slot is defined adjacent to the second shelf bearing portion on the second shelf support. A shelf member includes a first tab and a second tab, the first tab being fixed within the first slot, and the second tab being fixed within the second slot. A portion of the shelf member spans a distance between the first and second shelf support members.

In another aspect of the embodiments described herein, a wall assembly for a shipping container is provided. The wall assembly includes a first shelf support member including a first shelf bearing portion and a second shelf bearing portion. The first and second shelf bearing portions define a first notch therebetween. A second shelf support member includes a third shelf bearing portion and a fourth shelf bearing portion. The third and fourth shelf bearing portions define a second notch therebetween. At least one shelf member has a first end and a second end. The shelf member includes a first portion extending along a length of the shelf member, the first portion including a first tab at the first end, and a second tab at the second end. The first tab is fixed within the first notch and the second tab is fixed within the second notch. The at least one shelf member is fixed about the contours of the second and fourth shelf bearing portions.

DETAILED DESCRIPTION

FIGS. 1-16 illustrate one embodiment of a container 10 for use in storing, shipping, and protecting any of a variety of substantially flat components or sub-assemblies (for example, sunroofs mountable in automobile assemblies.) In the embodiment disclosed herein, unless otherwise stated, components of the container are formed using known processes from one or more laminated layers of a corrugated material, such as a corrugated board or paper material. However, the use of alternative materials, such as wood, polymers, or metals is also contemplated. In addition, unless otherwise stated, known methods of joining together pieces of corrugated material, such as nailing, gluing or adhesive application, stapling, bump stitching, and other known methods are all contemplated for use in assembling the container and components described herein.

Figure 1:
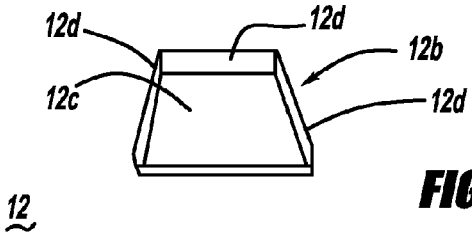
FIG. 1 is an exploded schematic view of a container base in accordance with one embodiment described herein.

FIG. 1 illustrates a base 12 of the container 10. Base 12 comprises a frame portion 12*a* (for example, a corrugated laminate pallet, or a wooden shipping pallet) and a container bottom portion 12*b*. Bottom portion 12*b* has a body 12*c* and a plurality of flaps 12*d* formed along edges of body 12*e*. Bottom portion 12*b* may also be formed from a sheet of corrugated material cut to form flaps 12*d*, which are then folded upward and secured to each other as shown to form a tray-like structure. The bottom portion is then nailed, glued, stapled, or otherwise secured to frame portion 12*a*.

Figure 2:
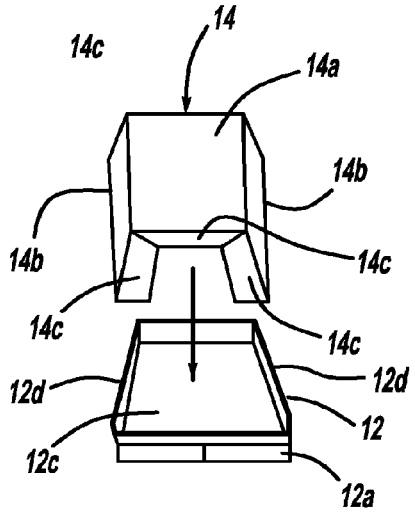
FIG. 2 is an exploded schematic view showing attachment of a body portion of the container to the base portion of FIG. 1, in accordance with one embodiment described herein.

Referring to FIG. 2, a body portion 14 of the container is positioned and secured within base portion 12. Body portion 14 has a rear wall portion 14*a* including a pair of opposite side edges, and a side flap 14*b* attached to each of the rear wall opposite edges. Base flaps 14*e* are formed along a bottom edge of rear wall portion 14*a* and along bottom edges of each of side flaps 14*b*. Base flaps 14*c* are secured to base portion body 12*c* and to base portion flaps 12*d*, thereby attaching the body portion 14 to the base. Body portion 14 may be formed from a sheet of corrugated material cut to form side flaps 14*b* and base flaps 14*c* which are then folded as shown and secured to base portion body 120 and to base portion flaps 12*d*. Taken together, tear wall portion 14*a* and side flaps 14*b* define a portion of an interior of the container.

Figure 3:
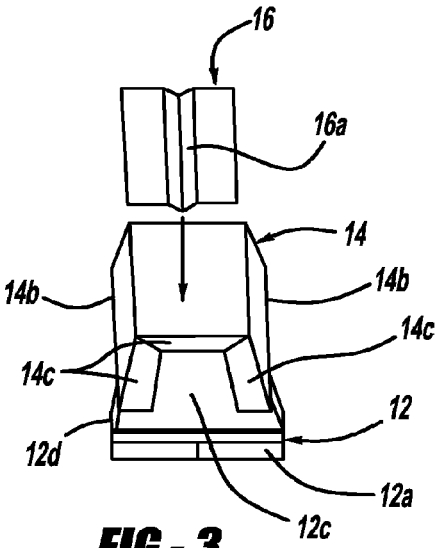
FIG. 3 is a partial exploded view showing attachment of a rear stop portion 16 to the body portion of FIG. 2, in accordance with one embodiment described herein.

Referring to FIG. 3, a rear stop portion 16 is secured to an interior surface of rear wall portion 14*a* to provide a cushion or shock absorbing member for articles inserted into and stored in container 10. Rear stop portion 16 may also occupy dead space between rear wall portion 14*a* and edges of the components stored in the container, thereby aiding in immobilization of the components stored in the container. Rear stop portion 16 may be formed from a sheet of corrugated material cut to size and folded as shown to produce a shock-absorbing wedge 16*a* therein. The rear stop portion is then positioned and secured to rear wall portion 14*a* of body portion 14. Alternatively, team or other padding may be secured to rear wall portion 14*a* of body portion 14 to provide the desired cushioning effect.

Figure 4:
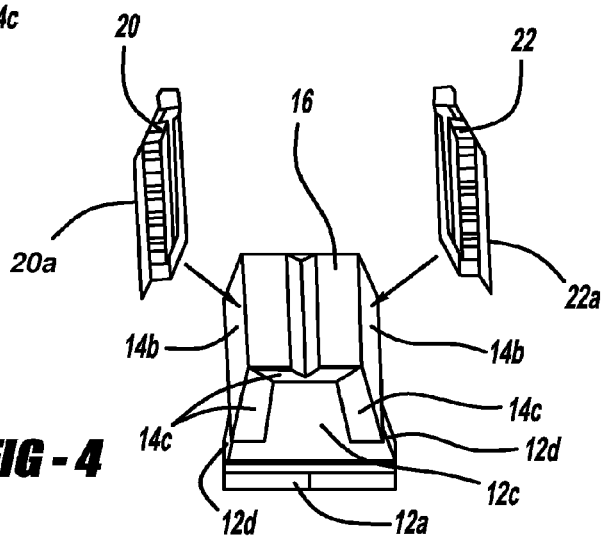
FIG. 4 is an exploded schematic view showing attachment of walls of the container to the body portion of FIG. 2, in accordance with one embodiment described herein.
Figure 5A:
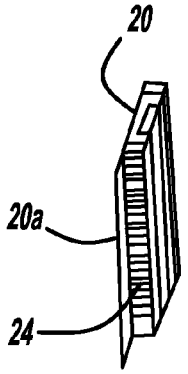
FIG. 5A is a schematic assembled view of a left wall of a shipping container in accordance with one embodiment described herein.
Figure 5B:
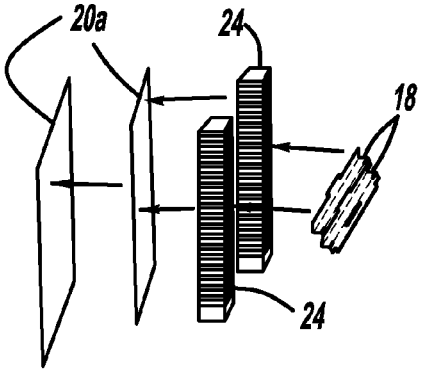
FIG. 5B is an exploded view of the left wall shown in FIG. 5A.
Figure 5C:
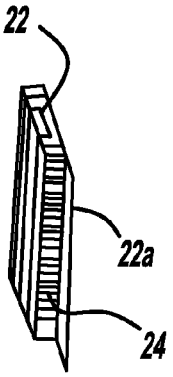
FIG. 5C is a schematic assembled view of a right wall of a shipping container in accordance with one embodiment described herein.
Figure 5D:
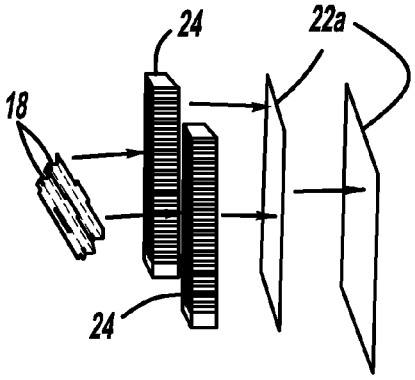
FIG. 5D is an exploded view of the right wall shown in FIG. 5C.

Referring to FIGS. 4-8, a left wall assembly 20 and right wall assembly 22 of the container are provided for supporting the components to be stored and shipped in the container. Wall assemblies 20, 22 each include respective wall portions 20*a*, 22*a*, a plurality of shelf support members or portions 24 secured to wall portions 20*a*, 22*a*, and a plurality of shelf portions 18 secured to wall portions 20*a*, 22*a* and supported by shelf support members 24. As shown in FIG. 4, each of wall assemblies 20 and 22 is attached to body portion 14 by attaching or fixing a respective one of wall portions 20*a*, 22*a* to an associated one of the side flaps 14*b*, using adhesives, staples, or any other suitable means. FIG. 5A shows left wall assembly 20 along a left-hand margin of the drawing. FIG. 5B shows the components of left wall assembly 20 in an exploded view adjacent the assembled view in FIG. 5A. FIG. 5C shows right wall assembly 22 along a left-hand margin of the drawing. FIG. 5D shows the components of right wall assembly 22 in an exploded view adjacent the assembled view in FIG. 5C. Attachment of a wall assembly to a respective wall portion and attachment of the wall portion to an associated side flap 14*b* forms an associated wall of the container.

Figure 6:
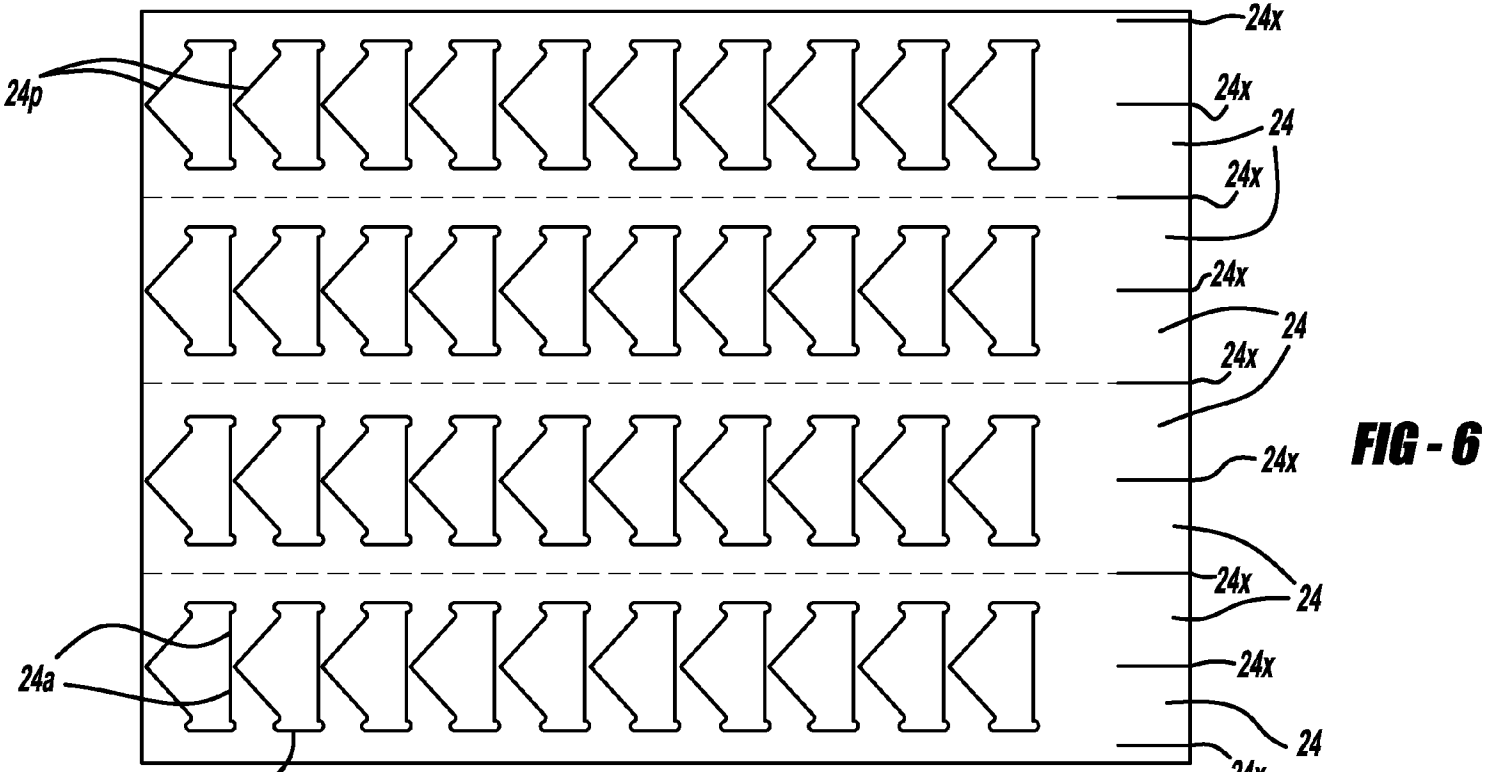
FIG. 6 is a plan view of a laminate of multiple layers of corrugated material for forming shelf support members in accordance with an embodiment described herein.
Figure 7:
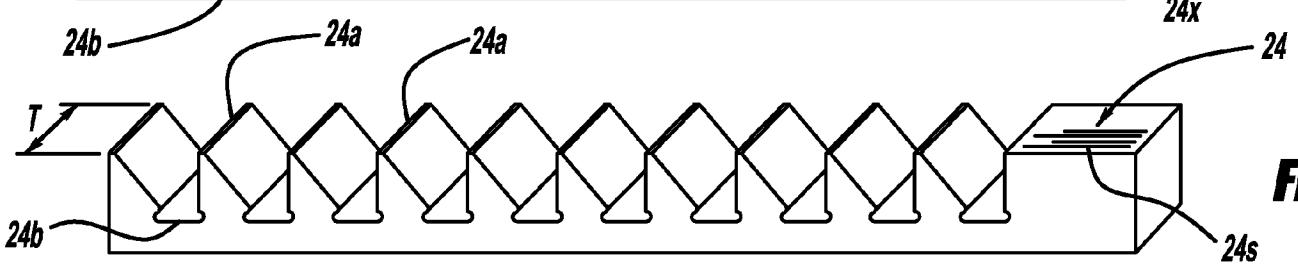
FIG. 7 is a perspective view of a shelf support member in accordance with an embodiment described herein.

FIG. 6 is a plan view of a laminate of multiple layers of corrugated material for use in forming shelf support members 24 of the present invention, shown prior to cutting into individual shelf support members. FIG. 7 is a perspective view showing a laminated shelf support member 24 of the container 10 of the present invention cut to shape. Each shelf support member 24 is formed from multiple individual layers 24*s* of corrugated material stacked and secured to each other to form a laminated structure. The pre-cut laminate block of FIG. 6 and the post-cut support member 24 shown in FIG. 7 each have a thickness T in the direction of stacking (which extends in a direction perpendicular to the plane of the drawing in FIG. 6, and which is shown in perspective in FIG. 7). The thickness T can have any desired value depending on the requirements of a particular application, and depends on the thicknesses of the individual layers forming the laminated structure and the number of layers. Shelf support members 24 may be formed as shown in FIGS. 6 and 7, wherein one or more sheets 24*s* of corrugated material are stacked and secured to each other in the stacked condition. Then, the outer edges and interior of the stack of attached sheets in FIG. 6 is cut along interior portions thereof as shown to provide adjacent profile shapes 24*p* forming the bearing portions 24*a* and slots 24*b* of the shelf support members 24. The profiled laminate block may then be cut lengthwise into sections along lines 24*x* (shown in FIG. 6) to provide multiple individual shelf support members 24 (one of which is shown in FIG. 7). For example, using the laminate arrangement of FIG. 6, eight shelf support portions 24 as shown in FIG. 7 may be cut from a single laminate block.

The laminate may be formed to any desired thickness, subject to any process limitations, to provide a desired degree of strength to the shelf support member. As seen in FIGS. 6 and 7, in one embodiment, each shelf support portion 24 includes a plurality of bearing portions 24*a*, with a slot 24*b* formed between adjacent ones of bearing portions 24*a*. In the embodiment shown, bearing portions 24*a* each have a sawtooth configuration or wedge shape which provides a relatively strong base in the region of the bearing portion which is under the greatest mechanical stresses, due to the weight of the part being supported. Slots 24*b* are dimensioned (in conjunction with tabs 18*f* on shelf portions 18, described in greater detail below) so as to provide an interference fit with tabs 18*f* inserted therein, thereby providing additional structural stability to the container.

Figure 8:
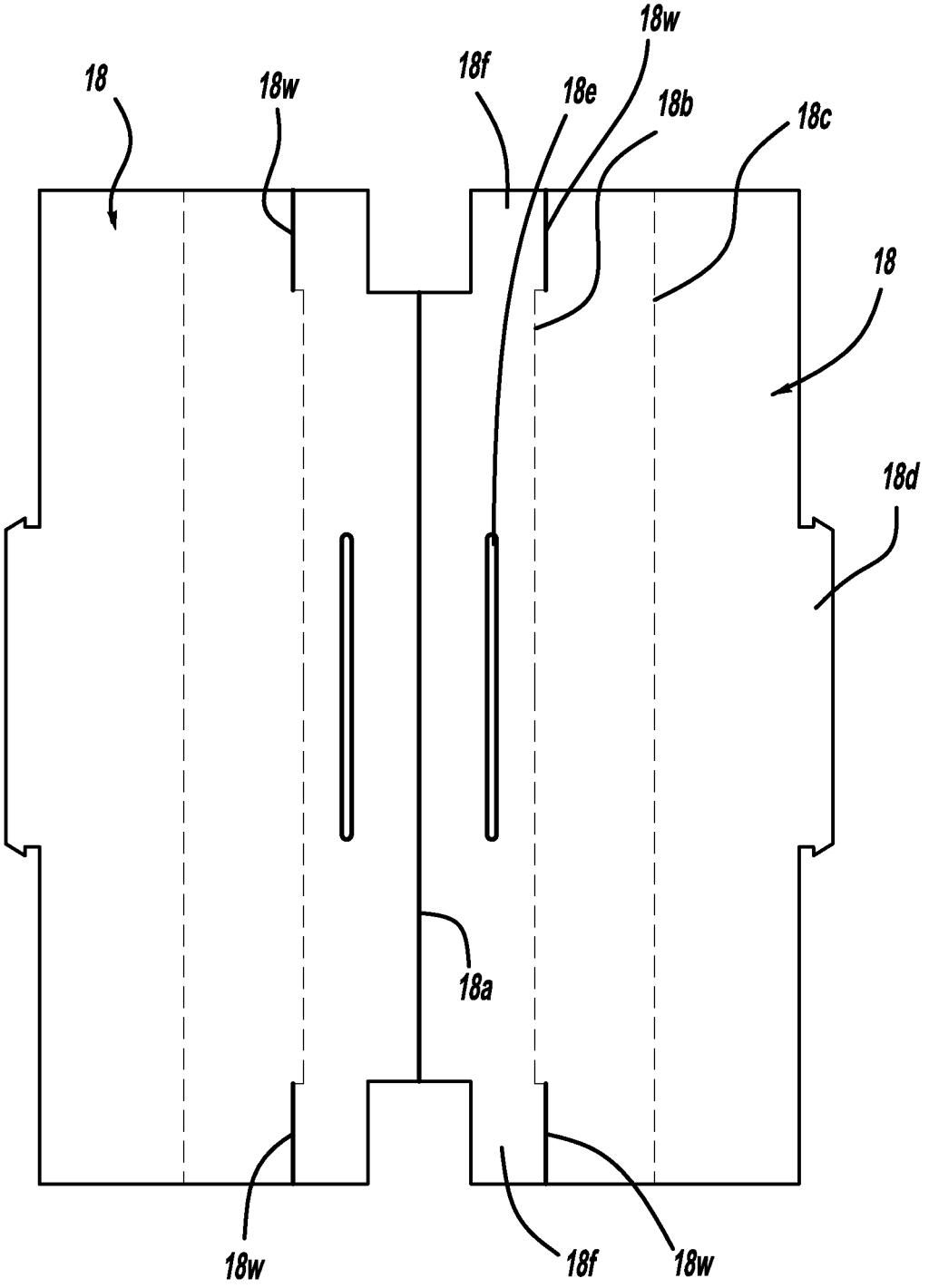
FIG. 8 is a plan view of a blank structured for cutting to provide a pair of shelf portions in accordance with an embodiment described herein.
Figure 16:
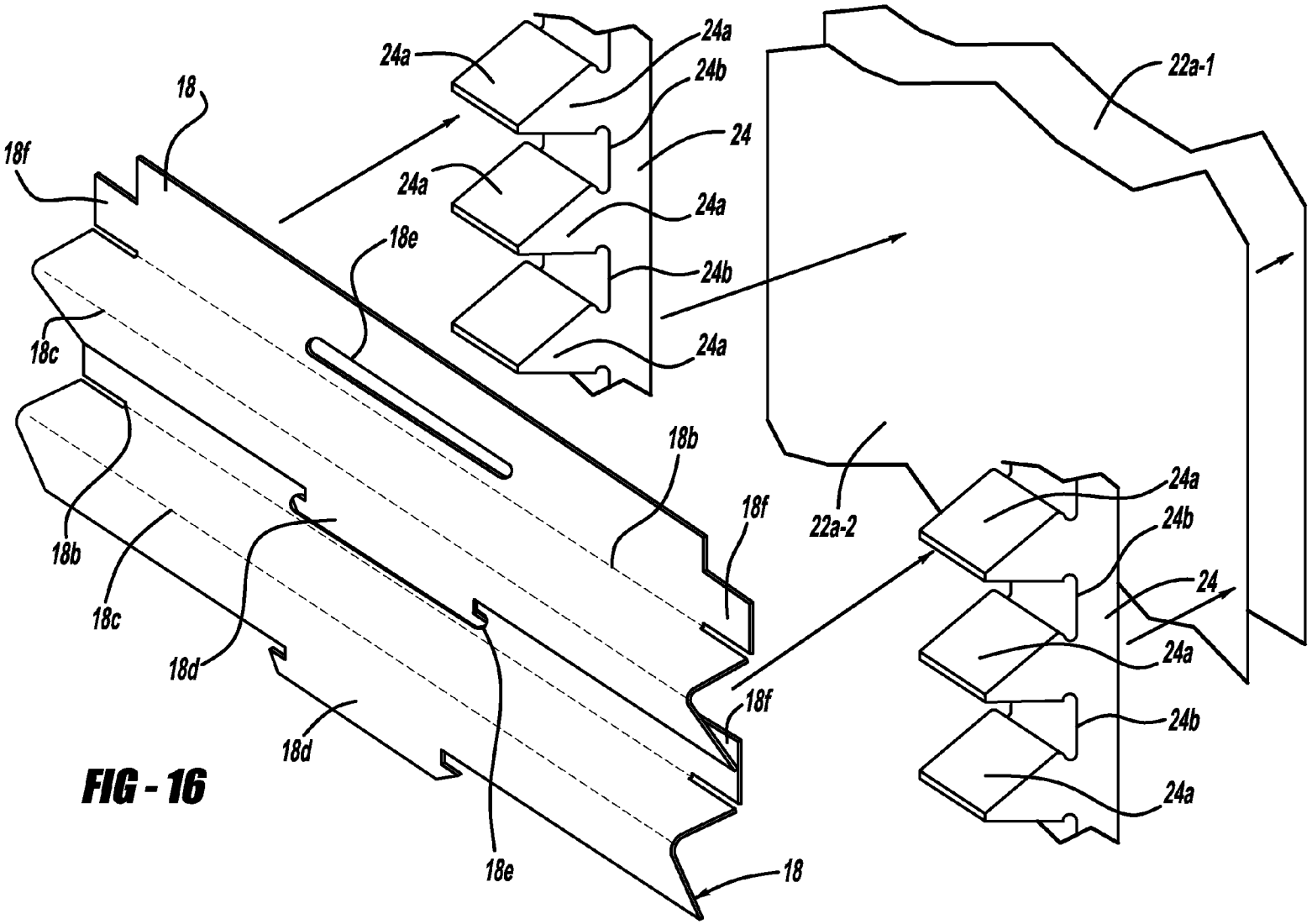
FIG. 16 is a schematic exploded perspective view of a portion of a wall in accordance with an embodiment described herein, showing the daisy-chaining and folding of adjacent shelf portions 18.

FIG. 8 is a plan view of a blank structured for cutting to provide a pair of shelf portions. In FIG. 8, cut lines are shown as solid lines and fold lines are shown as dashed lines. Referring to FIGS. 8 and 16, shelf portions 18 are provided which span a distance between adjacent shelf support members 24 along an associated one of wall assemblies 20 and 22, thereby providing substantially continuous support of the stored components along the lengths thereof when they are positioned and secured within the container. Shelf portions 18 may be formed as shown in FIG. 8, wherein one or more sheets of corrugated material are stacked and secured to each other in the stacked condition so as to form a blank. Then, the outer edges and interior of the blank or stack of attached sheets is cut to the shape shown and then cut down the center thereof (along line 18*a*) to form a pair of shelf members 18 which are symmetrical about cut line 18*a*. Portions of the stack defining the tabs 18*f* may be cut along lines 18*w* to enable the tabs to be bent or flexed with respect to the remainder of the shelf portion 18 when attaching the shelf portions 18 to associated shelf support portions 24 during assembly of the container.

In one method of assembly of wall assemblies 20, 22, one or more of each of wall portions 20*a* and 22*a* are provided. If multiple wall portions are used, the wall portions 20*a* are stacked on each other and secured together to form a first stacked wall portion assembly, and the wall portions 22*a* are sacked on each other and secured together to form a second stacked wall portion assembly. For each of the wall portion assemblies, a single wall portion may be used, or any desired number of the wall portions may be stacked on one another to provide a support base of sufficient thickness and strength to support shelf support members 24 in the manner described herein.

Figure 15:
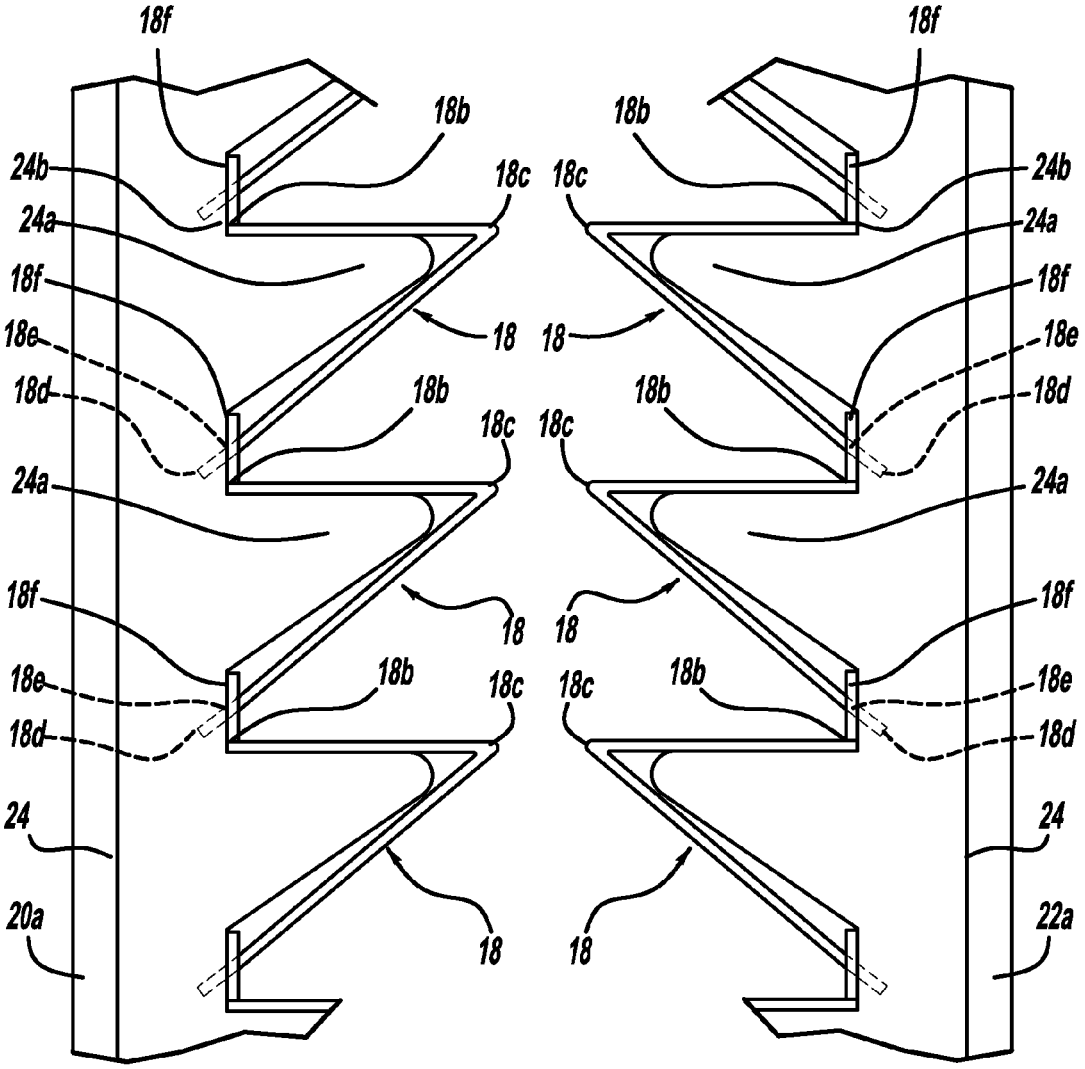
FIG. 15 is a cross-sectional view of portions of opposed walls 20 and 22 of a shipping container in accordance with one embodiment described herein, showing an arrangement of opposed shelf portions 18 and the folding of shelf portions 18 along contours of associated shelf support portions 24.

First and second shelf support members 24 are then attached to the stacked wall portions 20*a* such that the support members 24 extend parallel with each other, and such that each bearing portion 24*a* on one of the first and second shelf support members 24 is aligned with an associated bearing portion 24*a* on the other one of the first and second support members 24, in addition, third and fourth shelf support members 24 are attached to the stacked wall portions 22*a* such that the support members 24 extend parallel with each other, and such that each bearing portion 24*a* on one of the third and fourth shelf support members 24 is aligned with an associated bearing portion 24*a* on the other one of the third and fourth support members 24. Shelf portions 18 are then attached to the shelf support members in the manner described below. FIG. 15 is a side view of portions of opposed wall assemblies 20 and 22 of a shipping container in accordance with one embodiment described herein. FIG. 16 is a schematic exploded perspective view of a portion of a wall in accordance with an embodiment of the present invention, showing the daisy-chaining and folding of adjacent shelf portions 18.

Figure 16A:
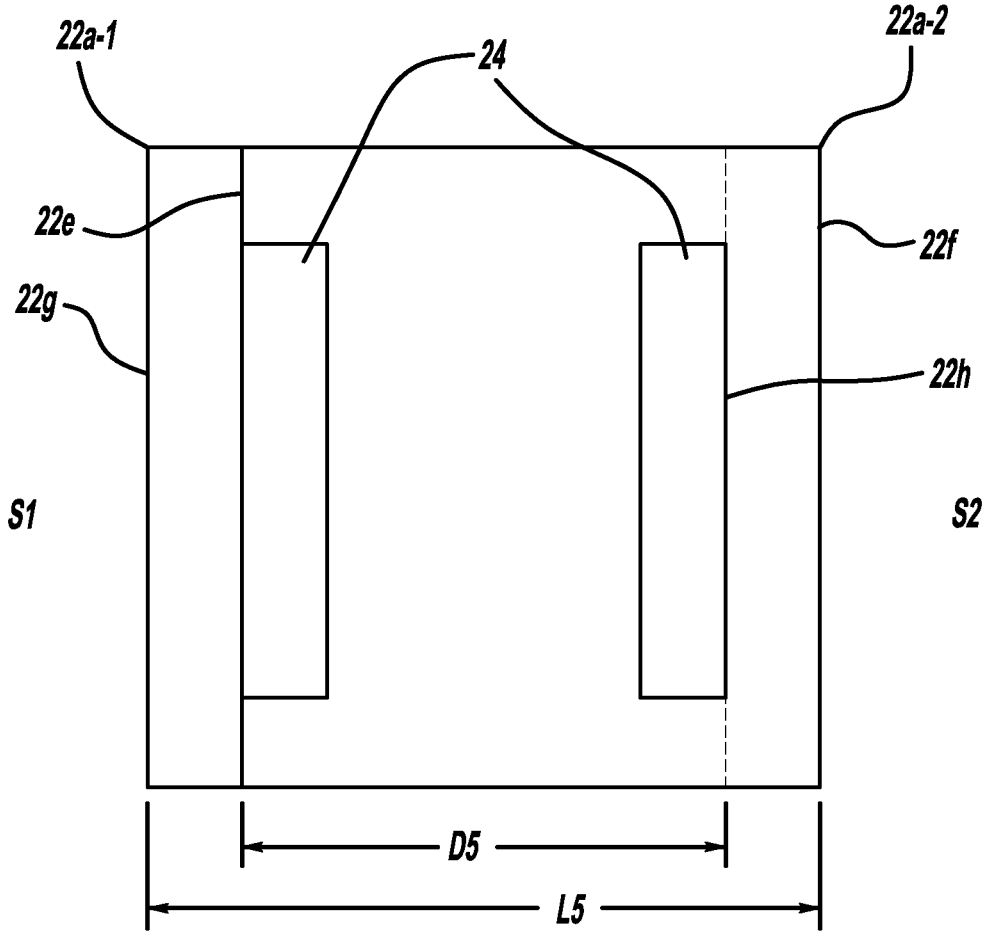
FIG. 16A is a side view of a portion of a wall assembly in accordance with another embodiment described herein.

The following description applies equally to wall portion assemblies termed by stacking wall portions 20*a* together or by stacking wall portions 22*a* together. Referring to FIG. 16A, in a particular embodiment, a pair of all portions 22*a*-1 and 22*a*-2 is stacked (as shown in FIG. 6) so that a vertically-extending edge 22*g* of wall portion 22*a*-1 overlaps a vertically-extending, edge 22*e* of wall portion 22*a*-2 along an edge S1 of the stack, and a vertically-extending edge 22*f* of wall portion 22*a*-2 overlaps a vertically-extending edge 22*h* of wall portion 22*a*-1 along another edge S2 of the stack. In this configuration, the overlapped edges 22*e* and 22*h* are spaced apart a distance D5. In addition, shelf support members 24 are secured to the innermost wall portion 22*a*-2 such that outermost longitudinal edges of the support members 24 are aligned with the overlapped edges 22*e* and 22*h* and are spaced apart the distance D5 as shown in FIG. 16A. This arrangement allows a maximum spacing of the support members 24 for a given length L5 of the wall assembly, while still enabling attachment of the support members 24 to a stacked or relatively thicker portion of the wall portion assembly, rather than attaching one or more of the support members 24 to a portion of the assembly comprising a single layer 22*a* of material.

Referring to FIGS. 8, 15 and 16, shelf portions 18 are folded along folds 18*b* and 18*c* (FIG. 8), to substantially conform to the profile of bearing portions 24*a* (FIGS. 6 and 7) of shelf support portions 24. Successive ones of shelf members 18 are then connected or daisy-chained together by fixing or inserting tab 18*d* from one shelf portion 18 into slot or aperture 18*e* of an adjacent shelf portion 18, thereby creating a continuous, accordion-like shelf structure. "Fixing" may mean simply inserting the tab or flap 18*d* into the corresponding aperture 18*e* of the next adjacent shelf member 18. Or, "fixing" may mean to glue or otherwise ensure that flap 18*d* is snugly fit within aperture 18*e* of the subsequent or adjacent shelf member 18. This shelf structure may be easily positioned to follow the contours defined by shelf support bearing portions 24*a*, by bending tabs 18*f* out of the plane of the shelf section on which they are formed, and inserting the tabs 18*f* into corresponding slots 24*b* formed or defined between adjacent bearing portions 24*a* of shelf support portions 24. Tabs 18*f* are formed in positions along shelf portions 18 such that insertion of the tabs into slots 24*b* forces the shelf portion structure to bend according to the contours of the shelf support portion. When all of tabs 18*f* have been inserted into associated slots 24*b*, the tabs are bent back into the plane in which they were originally formed, during which a formed end of each shelf portion 18 wraps over a corresponding surface of a bearing member 24*a* of shelf support portion 24. Shelf portions 18 are now supported at each end thereof by a bearing portion 24*a*. Shelf support portions 24 may then be positioned along wall portions 20*a*, 22*a* and glued or otherwise secured to the wall portions. In FIG. 15, the portions of walls 20 and 22 are shown spaced more closely together than in an actual shipping container, in order to convey the arrangement of the opposed shelf portions 18 with respect to each other. The wall portions are also magnified to show how the shelf portions 18 are folded about the shelf support portions 24. FIGS. 15 and 16 also show the daisy chaining of adjacent shelf portions 18 by inserting tab 18*d* of a first shelf portion into a slot or aperture 18*e* of an adjacent shelf portion, as described in above.

Each shelf portion 18 is also folded so that adjacent shelf portions 18 may be daisy-chained together by inserting tab 18*d* from one shelf portion 18 into slot or aperture 18*e* of an adjacent shelf portion 18. As understood in the art, "daisy-chaining" involves directly connecting identical or similar components in a chain-like structure. For example, in components or pieces each having first and second portions usable for connecting the component to adjacent, similar or identical components, the first portion of component A will be connected to the second portion of an adjacent component B, and the second portion of component A will be connected to the first portion of an adjacent component C. Components B and C are also similarly connected to adjacent similar or identical components spaced apart from component A. Thus, each piece in the chain is directly connected only to either one or two distinct and immediately adjacent pieces. As applied to the shelf portions 18 described herein, daisy-chaining is accomplished by inserting tab 18*d* from one shelf portion 18 into slot or aperture 18*e* of an adjacent shelf portion 18, as shown in FIGS. 15 and 16

Other assembly methods or sequences are also contemplated. For example, shelf support portions 24 may be secured to wall portions 20*a*, 22*a* prior to attachment of shelf portions 18 thereto. When walls 20, 22 are complete, each wall is secured to a corresponding side flap 14*b* of body portion 14.

Figures 11, 12, 13, 14A, 14B:
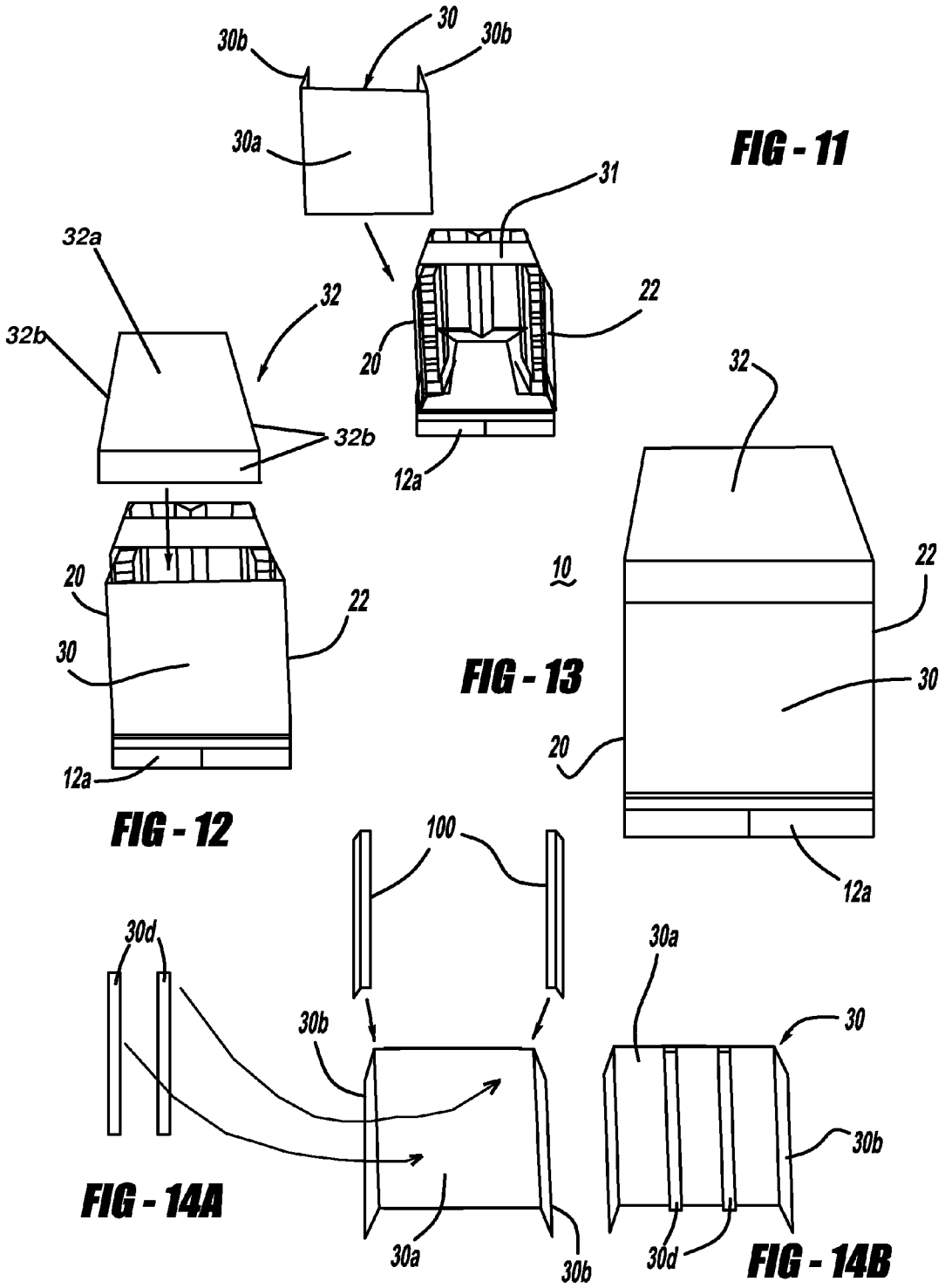
FIG. 11 is a partial exploded view showing attachment of the front of the container to the walls of the container, in accordance with one embodiment described herein.
FIG. 12 is a partial exploded front schematic view showing the container prior to application of the top portion 32 thereto.
FIG. 13 is front view of the container in an assembled condition.
FIG. 14A is a partial exploded view of a front portion of the container in accordance with an embodiment described herein.
FIG. 14B is an assembled view of the front portion of the container shown in FIG. 14A.

FIG. 14A shows an exploded view of a front 30 of the container. FIG. 14B is an assembled view of the front portion of the container shown in FIG. 14A. Front 30 comprises a body 30*a* and a plurality of flaps 30*b* formed along edges of body 30*a*. Front 30 may be formed from a sheet of corrugated material cut to form flaps 30*b*, which are then folded and secured to each other as shown so as to wrap over corresponding front edges of walls 20, 22. One or more shock absorbing positioning members 30*d* such as rear stop portion or a foam padding, similar to that provided along rear wall 14*a*, may be secured to an interior surface of front 30 as shown in FIG. 14. In addition, if desired, optional corner pieces 100 may be applied to one or more exterior corners of the container (at the intersections of body 30*a* and flaps 30*b*) to provide an additional degree of rigidity to the container.

Figure 9:
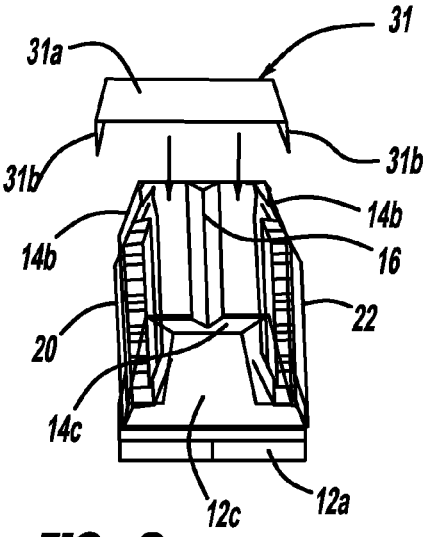
FIG. 9 is a partial exploded view showing attachment of a top of the container to the walls and rear portion of the container, in accordance with one embodiment described herein.

FIG. 9 shows application of an optional sub-cover 31 to a top portion of the container. Sub-cover 31 comprises a body 31*a* and a plurality of flaps 31*b* formed along edges of body 31*a*. Sub-cover 31 may be formed from a sheet of corrugated material cut to form flaps 31*b*, which may then be folded over and secured to exterior surfaces of associated ones of wall assemblies 20 and 22. The sub-cover 31 may be used to provide an additional degree of rigidity to the container and to aid in supporting the cover top (described below) if desired.

Figure 10:
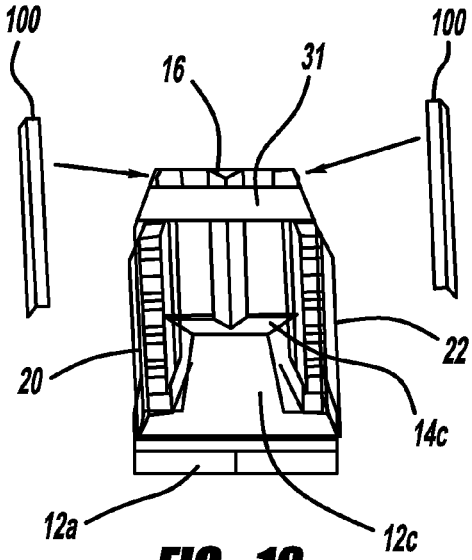
FIG. 10 is a schematic front view looking into an interior of the container, and showing attachment of an optional subcover to the container.

FIGS. 10-13 show various stages in the final assembly of the shipping container 10. FIG. 10 is a schematic front view looking into an interior of the container after application of optional sub-cover 31 to the container. If desired, optional corner pieces 100 may be applied to one or more exterior corners of the container to provide an additional degree of rigidity to the container.

FIG. 11 is a partial exploded schematic view showing attachment of the front 30 of the container to the wall assemblies 20 and 22 of the container. Front 30 may be attached to side wall assemblies 20 and 22 using adhesives, staples, or any other suitable method.

FIG. 12 shows application of top or cover 32 to the container. Top 32 comprises a body 32*a* and a plurality of flaps 32*b* formed along edges of body 32*a*. Top 32 may be formed from a sheet of corrugated material cut to form flaps 32*b*, which are then folded and secured to each other as shown to form a top which may be wrapped over upper edges of walls 20, 22, rear wall portion 14*a* and front 30.

It should be understood that the present description is for illustrative purposes only, and should not be interpreted to limit the scope of the present invention in any way. Thus, those skilled in the art will appreciate that various modifications to the disclosed embodiments might be made without departing from the intended spirit and scope of the present invention, which should be given the full breadth of the claims and any and all equivalents thereof. For example, a preferred embodiment has been illustrated as having four walls, however, the shelf assembly that is an object of the present invention might find application in three sided or many sided containers, or even as a separate stand alone shelf. As discussed above, substantial variations might be made to the number and positioning of shelf assemblies within the container, allowing goods of differing shapes and sizes to be positioned in the same container, for instance, sunroofs for different vehicle models. Further, the presently disclosed shelf assembly could find application in containers designed not for shipping, but for permanent storage or display of manufactured articles. Other objects and features of the present invention will be evident upon an examination of the attached drawing figures and appended claims.

What is claimed is:

1. A container for shipping and storing manufactured articles, said container comprising:

a base;

a container body portion secured to the base, the container body portion defining an interior of the container;

a first wall assembly secured to the container body, the first wall assembly including a wall portion, a first shelf support member secured to the wall portion, and a second shelf support member secured to the wall portion and spaced apart from the first shelf support member, for supporting at least one shelf member;

a first shelf member secured to the first and second shelf support members by a mechanism located on a side of the wall portion facing an interior of the container, the first shelf member comprising a first end and a second end, a first tab at said first end, a second tab at said second end, a first flap, and a first aperture;

a first bearing portion for support of said first shelf member, and a second bearing portion adjacent the first bearing portion, said first and second bearing portions being integral to said first shelf support member, said first and second bearing portions defining a first slot therebetween, said first tab being fixed within said first slot; and a third bearing portion for support of said first shelf member, and a fourth bearing portion adjacent the third bearing portion, said third and fourth bearing portions being integral to said second shelf support member, said third and fourth bearing portions defining a second slot therebetween, said second tab being fixed within said second slot, wherein the first tab forms an interference fit with the first and second bearing portions, and the second tab forms an interference fit with the third and fourth bearing portions.

2. The container of claim 1 further comprising:

a second wall assembly secured to the container body opposite the first wall assembly, the second wall assembly including a second shelf assembly protruding into the interior across from said first shelf assembly, said second shelf assembly including a third shelf support member and a fourth shelf support member for supporting at least one shelf member;

a second shelf member separate from the first shelf member and comprising a third end positioned opposite said first end of said first shelf member, and a fourth end positioned opposite said second end of said first shelf member, a third tab at said third end, a fourth tab at said fourth end, a second flap, and a second aperture;

a fifth bearing portion and a sixth bearing portion integral to said third shelf support member for support of said second shelf member, said fifth and sixth bearing portions defining a third slot, said third tab fixed within said third slot; and a seventh bearing portion and an eighth bearing portion integral to said fourth shelf support member for support of said second shelf member, said seventh and eighth bearing portions defining a fourth slot, said fourth tab fixed within said fourth slot, wherein said second shelf member is substantially parallel to said first shelf member.

3. The container of claim 2 further comprising:

a third shelf member adjacent to and substantially parallel to said first shelf member, said third shelf member comprising fifth tab at one end, a sixth tab at a second end, and a third aperture; and a fourth shelf member adjacent to and substantially parallel to said second shelf member, said fourth shelf member comprising a seventh tab at one end, an eighth tab at a second end, and a fourth aperture, wherein the first flap of said first shelf member is fixed within the third aperture of said third shelf member and the second flap of said second shelf member is fixed within the fourth aperture of said fourth shelf member.

4. The container of claim 1 wherein the container body comprises a rear wall portion having a pair of opposite side edges, a side flap attached to each of the rear wall portion edges, a base flap extending from the rear wall and attached to the base, and a base flap extending from each side flap and attached to the base, and wherein the first wall assembly is secured to one of the side flaps.

5. The container of claim 1 wherein the first shelf portion is secured to the first shelf support member by fixing of the first tab within the first slot, and wherein the first shelf portion is secured to the second shelf support member by fixing of the second tab within the second slot.

6. A shipping container comprising:

a first wall including a first shelf support member, the first shelf support member comprising a first plurality of adjacent and integral shelf bearing portions;

the first wall also including a second shelf support member the second shelf support member being separate from and spaced apart from the first shelf support member, the second shelf support member comprising a second plurality of adjacent and integral shelf bearing portions, each one of said second plurality of shelf bearing portions corresponding to one of said first plurality of shelf bearing portions;

a first plurality of slots, each slot of said first plurality of slots being defined between two adjacent shelf bearing portions of said first plurality of shelf bearing portions;

a second plurality of slots, each slot of said second plurality of slots defined between two adjacent shelf bearing portions of said second plurality of shelf bearing portions; and a first plurality of shelf members extending between the first and second shelf support members, each shelf member comprising a first tab, a second tab, a third tab, and an aperture, wherein each first tab is fixed within one slot of said first plurality of slots, each second tab is fixed within one slot of said second plurality of slots, and each third tab mates with an aperture of an adjacent shelf member.

7. The shipping container of claim 6 wherein said shelf bearing portions are saw tooth-shaped portions.

8. The shipping container of claim 6 further comprising:

a second wall positioned opposite the first wall, the second wall including a third shelf support member the second wall comprising a third plurality of adjacent and integral shelf bearing portions;

the second wall also including a fourth shelf support member, the fourth shelf support member being separate and spaced apart from the third shelf support member, the fourth shelf support member comprising a fourth plurality of adjacent and integral shelf bearing portions, each one of said fourth plurality of shelf bearing portions corresponding to one of said third plurality of shelf bearing portions;

a third plurality of slots, each one of said third plurality of slots defined between two adjacent shelf bearing portions of said third plurality of shelf bearing portions;

a fourth plurality of slots, each one of said fourth plurality of slots defined between two adjacent shelf bearing portions of said fourth plurality of shelf bearing portions; and a second plurality of shelf members extending between the third and fourth shelf support members, each shelf member comprising a first tab, a second tab, a third tab, and an aperture, each one of said shelf members of said second plurality corresponding to a respective one of said first plurality of shelf members, and said second plurality of shelf members in substantially parallel orientation to said first plurality of shelf members, wherein with regard to said second plurality of shelf members, each first tab is fixed within one of said third plurality of slots, each second tab is fixed within one of said fourth plurality of slots, and each third tab mates with an aperture of an adjacent shelf member.

9. A wall assembly for a shipping container, the wall assembly comprising:

at least one wall portion having a first side structured to face an interior of the container;

a first shelf support member secured to the at least one wall portion, the first shelf support member including a first shelf bearing portion;

a second shelf support member secured to the at least one wall portion, the second shelf support member being separate from and spaced apart from the first shelf support member, the second shelf support member including a second shelf bearing portion;

a first slot defined adjacent to said first shelf bearing portion on said first shelf support;

a second slot defined adjacent to said second shelf bearing portion on said second shelf support; and a shelf member comprising a first tab and a second tab, said first tab fixed within said first slot and residing on the first side of the wall portion, and said second tab fixed within said second slot and residing on the first side of the wall portion, a plurality of shelf members, and, a first plurality of first tabs wherein each of said first tabs corresponds to a respective shelf member, a second plurality of second tabs wherein each of said second tabs corresponds to a respective shelf member, a third plurality of third tabs wherein each of said third tabs corresponds to a respective shelf member, and a plurality of apertures wherein each of said apertures corresponds to a respective shelf member, a first plurality of adjacent shelf bearing portions integral to said first shelf support member;

a second plurality of adjacent shelf bearing portions integral to said second shelf support member;

a first plurality of slots, each of said first plurality of slots defined between two adjacent shelf bearing portions of said first plurality of bearing portions;

a second plurality of slots, each of said second plurality of slots defined between two adjacent shelf bearing portions of said second plurality of shelf bearing portions, wherein a portion of the shelf member spans a distance between the first and second shelf support members, and each first tab is fixed within one of said first plurality of slots, each second tab is fixed within one of said second plurality of slots, and each third tab mates with an aperture of an adjacent shelf member.

10. The wall assembly of claim 9 wherein said shelf bearing portions are saw tooth-shaped portions.

11. A container for shipping and storing manufactured articles, said container comprising:

a base;

a container body portion secured to the base, the container body portion defining an interior of the container;

a first wall assembly secured to the container body, the first wall assembly including a wall portion, a first shelf support member secured to the wall portion, and a second shelf support member secured to the wall portion and spaced apart from the first shelf support member, for supporting at least one shelf member;

a first shelf member secured to the first and second shelf support members by a mechanism located on a side of the wall portion facing an interior of the container, the first shelf member comprising a first end and a second end, a first tab at said first end, a second tab at said second end, a first flap, and a first aperture;

a first bearing portion for support of said first shelf member, and a second bearing portion adjacent the first bearing portion, said first and second bearing portions being integral to said first shelf support member, said first and second bearing portions defining a first slot therebetween, said first tab being fixed within said first slot;

a third bearing portion for support of said first shelf member, and a fourth bearing portion adjacent the third bearing portion, said third and fourth bearing portions being integral to said second shelf support member, said third and fourth bearing portions defining a second slot therebetween, said second tab being fixed within said second slot;

a second wall assembly secured to the container body opposite the first wall assembly, the second wall assembly including a second shelf assembly protruding into the interior across from said first shelf assembly, said second shelf assembly including a third shelf support member and a fourth shelf support member for supporting at least one shelf member;

a second shelf member separate from the first shelf member and comprising a third end positioned opposite said first end of said first shelf member, and a fourth end positioned opposite said second end of said first shelf member, a third tab at said third end, a fourth tab at said fourth end, a second flap, and a second aperture;

a fifth bearing portion and a sixth bearing portion integral to, said third shelf support member for support of said second shelf member, said fifth and sixth bearing portions defining a third slot, said third tab fixed within said third slot;

a seventh bearing portion and an eighth bearing portion integral to said fourth shelf support member for support of said second shelf member, said seventh and eighth bearing portions defining a fourth slot, said fourth tab fixed within said fourth slot, wherein said second shelf member is substantially parallel to said first shelf member;

a third shelf member adjacent to and substantially parallel to said first shelf member, said third shelf member comprising fifth tab at one end, a sixth tab at a second end, and a third aperture; and a fourth shelf member adjacent to and substantially parallel to said second shelf member, said fourth shelf member comprising a seventh tab at one end, an eighth tab at a second end, and a fourth aperture, wherein the first flap of said first shelf member is fixed within the third aperture of said third shelf member and the second flap of said second shelf member is fixed within the fourth aperture of said fourth shelf member.

* * * * *